US007375944B2

(12) United States Patent
Izaki et al.

(10) Patent No.: US 7,375,944 B2
(45) Date of Patent: May 20, 2008

(54) IONIZER AND DISCHARGE ELECTRODE ASSEMBLY TO BE ASSEMBLED THEREIN

(75) Inventors: Tomomi Izaki, Osaka (JP); Yuki Tokita, Osaka (JP)

(73) Assignee: Keyence Corporation, Osaka-shi (JP)

( * ) Notice: Subject to any disclaimer, the term of this patent is extended or adjusted under 35 U.S.C. 154(b) by 0 days.

(21) Appl. No.: 11/349,345

(22) Filed: Feb. 8, 2006

(65) Prior Publication Data

US 2006/0193100 A1 Aug. 31, 2006

Related U.S. Application Data

(63) Continuation-in-part of application No. 10/995,041, filed on Nov. 23, 2004, now abandoned.

(30) Foreign Application Priority Data

Dec. 2, 2003 (JP) ..... 2003-402497
Jun. 23, 2004 (JP) ..... 2004-185007

(51) Int. Cl.
*H01T 23/00* (2006.01)

(52) U.S. Cl. ..... 361/230

(58) Field of Classification Search ..... 361/230
See application file for complete search history.

(56) References Cited

U.S. PATENT DOCUMENTS 2,316,237 A 4/1943 Grunert et al.
3,179,849 A 4/1965 Schweriner
4,665,462 A 5/1987 Blitshteyn et al.
5,550,703 A 8/1996 Beyer et al.
5,847,917 A 12/1998 Suzuki
6,653,638 B2 11/2003 Fujii
2002/0130269 A1 9/2002 Fujii
2005/0116167 A1 6/2005 Izaki et al.

FOREIGN PATENT DOCUMENTS

JP 2002-260821 A 9/2002
JP 2004-55397 A 2/2004
JP 2004055397 A * 2/2004

* cited by examiner

*Primary Examiner*—Michael Sherry
*Assistant Examiner*—Scott Bauer
(74) *Attorney, Agent, or Firm*—Smith Patent Office

(57) ABSTRACT

An ionizer of a corona discharge type is configured to increase the yield of ions while minimizing contamination of a discharge electrode by foreign matters. In the ionizer, a gas path unit (11) supplied with clean gas has internal clean gas paths (50, 48) in an electrode assembly (40), and clean gas is released through each internal clean gas path (50, 48) to make a clean gas flow enclosing a front end portion of a discharge electrode (12). The electrode assembly (40) has a guard ring (46) encircling the discharge electrode (12), and the guard ring (46) has external air inlet openings (46*b*) permitting free passage of atmospheric air. The clean gas flow enclosing the tip of the discharge electrode (12) inhales atmospheric air through external air inlet openings (46*b*) of the guard ring (46) and changes to ionized air.

15 Claims, 12 Drawing Sheets

IONIZER AND DISCHARGE ELECTRODE ASSEMBLY TO BE ASSEMBLED THEREIN

CROSS REFERENCE TO RELATED APPLICATION

This application is a continuation-in-part application of U.S. patent application Ser. No. 10/995,041 filed on Nov. 23, 2004, now abandoned. The disclosure of U.S. patent application Ser. No. 10/995,041 is hereby incorporated by reference.

FIELD OF THE INVENTION

This invention relates to controlling static electricity in air or electric discharge from a work. More particularly, the invention relates to an ionizer and a discharge electrode assembly mounted therein.

BACKGROUND OF THE INVENTION

Ionizers of a corona discharge type are widely used for controlling static electricity in air, such as cleaning of clean rooms and electric discharge from floating particles, as well as electric discharge from works.

FIG. 14 shows a discharge electrode bar of a currently available DC ionizer. The discharge electrode bar 1 has an elongated tubular case 2. Cylindrical nozzles 3*a*, 3*b*, each encircling a discharge electrode, are attached to the case 2 at intervals along the lengthwise direction of the case 2.

In the conventional discharge electrode bar 1, a high voltage source unit 4 or a control unit 5 is located between every adjacent nozzles 3, 3, and clean gas from each nozzle 3 is supplied through a flexible tube 6 extending inside the case 2. In FIG. 14, positive pole nozzles of the DC discharge electrode bar 1 are labeled with 3*a*, and negative pole nozzles are labeled with 3*b*.

In the conventional discharge electrode bar 1 in which the nozzles encircle the discharge electrodes, the nozzles charge with electricity of the same polarity as that of the discharge electrodes. Therefore, here is the problem that the nozzles attenuate the electric field around the discharge electrodes and hence reduce the yield of ions.

SUMMARY OF THE INVENTION

It is therefore an object of the invention to provide an ionizer of a corona discharge type free from a decrease of the yield of ions by nozzles, as well as a discharge electrode assembly to be assembled in the ionizer.

A further object of the invention is to provide an ionizer capable of preventing contamination of discharge electrodes as well as a discharge electrode assembly to be assembled in the ionizer.

A still further object of the invention is to provide an ionizer capable of simultaneously satisfying two different requirements, i.e. preventing contamination of the discharge electrode and assuring a sufficient yield of ions, as well as a discharge electrode assembly to be assembled in the ionizer.

According to the first aspect of the invention, there is provided an ionizer for generating ionized air by applying a high voltage to a discharge electrode and bringing about corona discharge, comprising:

a clean gas outlet coaxial with a front end of the discharge electrode, wherein ionized air is generated by clean gas jetting out through the clean gas outlet while inhaling the atmospheric air into the flow thereof.

In the first aspect of the invention, clean gas jetting out from the clean gas outlet inhales the atmospheric air near the discharge electrode, and flows down together with the atmospheric air in form of ionized air.

Unlike the conventional ionizer, the first aspect of the invention does not include a nozzle around the discharge electrode. Therefore, the ionizer according to the first aspect of the invention prevents attenuation of the electric field around the discharge electrode, which was the problem caused by electric charge of a nozzle in the conventional ionizer including the nozzle, and hence prevents degradation of the yield of ions. Furthermore, since the clean gas released from the clean gas outlet makes a clean gas flow close to the tip of the discharge electrode, the ionizer according to the first aspect of the invention prevents contamination of the tip of the discharge electrode with the aid of the clean gas flow.

The front end (tip) of the discharge electrode is preferably positioned on the centerline of the clean gas outlet and preferably projects forward of the clean gas outlet. In this case, the clean gas flow from the clean gas outlet encloses the tip of the discharge electrode, and constitutes a barrier against the open air. That is, although the tip of the discharge electrode projects forward, the clean gas flow prevents the open air from direct contact with the tip of the discharge electrode. In addition, the outer peripheral layer of the clean gas flow inhales the open air and merges with it at a position slightly distant forward from the tip of the discharge electrode. The total air is ionized there, and thereafter discharged forward. Thus, the ionizer assures a larger yield of ionized air because of a higher electric field applied from the tip of the discharge electrode projecting from the clean gas outlet than the yield of ionized air produced by an ionizer locating the tip of the discharge electrode inside the clean gas outlet. Simultaneously, the projecting tip of the discharge electrode is reliably protected from contamination by the open air because the clean gas flow functions as a barrier against the open air. Thus, the projecting height (distance) of the tip of the discharge electrode from the clean gas outlet is preferably determined depending upon a desirable balance between the requirement of preventing contamination of the discharge electrode and the requirement of increasing the yield of ionized air.

According to the second aspect of the invention, there is provided an ionizer for generating ionized air by applying a high voltage to a discharge electrode and bringing about corona discharge, comprising:

an electrode support member which supports the discharge electrode and defines a gas outlet for releasing clean gas which makes a clean gas flow enclosing the front end portion of the discharge electrode;

a finger guard provided at a location distant forward from the front end of the discharge electrode, and having an opening which prevents finger contact to the front end of the discharge electrode from the front outside while permitting gas ionized around the discharge electrode to flow out forward therethrough; and a plurality of legs connecting the finger guard to the electrode support member, wherein the clean gas flow enclosing the front end of the discharge electrode produces ionized air while inhaling atmospheric air which enters into the space surrounded by the plurality of legs through external air inlet openings between the legs.

In the second aspect of the invention, the front end (tip) of the discharge electrode is surrounded by spaced apart legs unlike the conventional ionizer in which a sleeve forming a continuous wall surrounds the tip of the discharge electrode. Therefore, the second aspect of the invention reduces the electricity charged in the legs in the same polarity as the discharge electrode as compared with the electricity charged in the sleeve used in the conventional ionizer. This means that the second aspect of the invention prevents attenuation of the electric field around the discharge electrode and hence prevents reduction of the yield of ions. Moreover, the clean gas flow encloses the tip of the discharge electrode, and thereby prevents its contamination by atmospheric air. Furthermore, in the second aspect of the invention, the finger guard protects operators from inadvertent finger touch to the tip of the discharge electrode.

In the ionizer according to the second aspect of the invention, the distal end portion of the discharge electrode is preferably positioned at the center of the clean gas outlet to ensure that the clean gas flow from the clean gas outlet encloses the front end portion of the discharge electrode. More preferably, the front end (tip) of the discharge electrode slightly projects forward of the clean gas outlet.

According to the third aspect of the invention, there is provided a discharge electrode assembly detachably assembled in an ionizer for generating ionized air by applying a high voltage to a discharge electrode and bringing about corona discharge, comprising:

a discharge electrode;

an electrode support member which supports the discharge electrode and defines a gas outlet for releasing clean gas which makes a clean gas flow enclosing the front end portion of the discharge electrode;

a finger guard provided at a location distant forward from the front end of the discharge electrode, and having an opening which prevents finger contact to the front end of the discharge electrode from the front outside while permitting gas ionized around the discharge electrode to flow out forward therethrough; and a plurality of legs connecting the finger guard to the electrode support member; and a clean gas outlet coaxial with a front end of the discharge electrode, wherein the clean gas flow enclosing the front end of the discharge electrode produces ionized air while inhaling atmospheric air which enters into the space surrounded by the plurality of legs through external air inlet openings between the legs.

When the discharge electrode assembly according to the third aspect of the invention is assembled in an ionizer, the ionizer fulfills the effects mentioned in conjunction with the ionizer according to the second aspect of the invention. Furthermore, when the ionizer degrades in performance because of wear of the discharge electrodes, the discharge electrode assembly enables replacement of the worn discharge electrode with a new discharge electrode to restore the initial performance of the ionizer. Moreover, during replacement, the finger guard of the discharge electrode assembly protects an operator from injury by inadvertent touch to the tip of the discharge electrode.

In the discharge electrode assembly according to the third aspect of the invention, the distal end portion of the discharge electrode is preferably positioned at the center of the clean gas outlet to ensure that the clean gas flow from the clean gas outlet encloses the front end portion of the discharge electrode. More preferably, the front end (tip) of the discharge electrode slightly projects forward of the clean gas outlet.

According to a more concrete aspect of the invention, there is provided an ionizer for generating ionized air by applying a high voltage to a discharge electrode and bringing about corona discharge, comprising:

an electrode support member which supports the discharge electrode and defines a gas path extending in the lengthwise direction of the discharge electrode to externally release clean gas from near the front end of the discharge electrode; and a guard ring including a ring main body having an opening at a location distant by a predetermined distance in the lengthwise direction of the discharge electrode from the electrode support member to permit clean gas to go out from the electrode support member through the opening, and including a plurality of legs connecting the ring main body to the electrode support member, wherein the ring main body has a shape continuous in the circumferential direction and has a diameter small enough to prevent intrusion of a finger tip, and wherein the clean gas flow enclosing the front end of the discharge electrode produces ionized air while inhaling atmospheric air which enters into the guard ring through external air inlet openings between every adjacent said legs.

In the more concrete aspect of the invention, the front end portion of the discharge electrode preferably lies on the center axis of the gas path, and the front end (tip) of the discharge electrode preferably projects slightly forward of a gas outlet of the gas path.

The guard ring has some major functions brought about by the ring main body. One of the major functions is a finger guard function to protect operator's fingers from touching the tip of the discharge electrode during replacement of a new discharge electrode, for example. Another function is to increase rigidity of the guard ring to prevent deformation of the guard ring when an operator pinches it with his/her fingers upon replacement of the discharge electrode.

DETAILED DESCRIPTION OF THE INVENTION

Some embodiments of the invention are explained below in detail with reference to the drawings.

Figure 1:
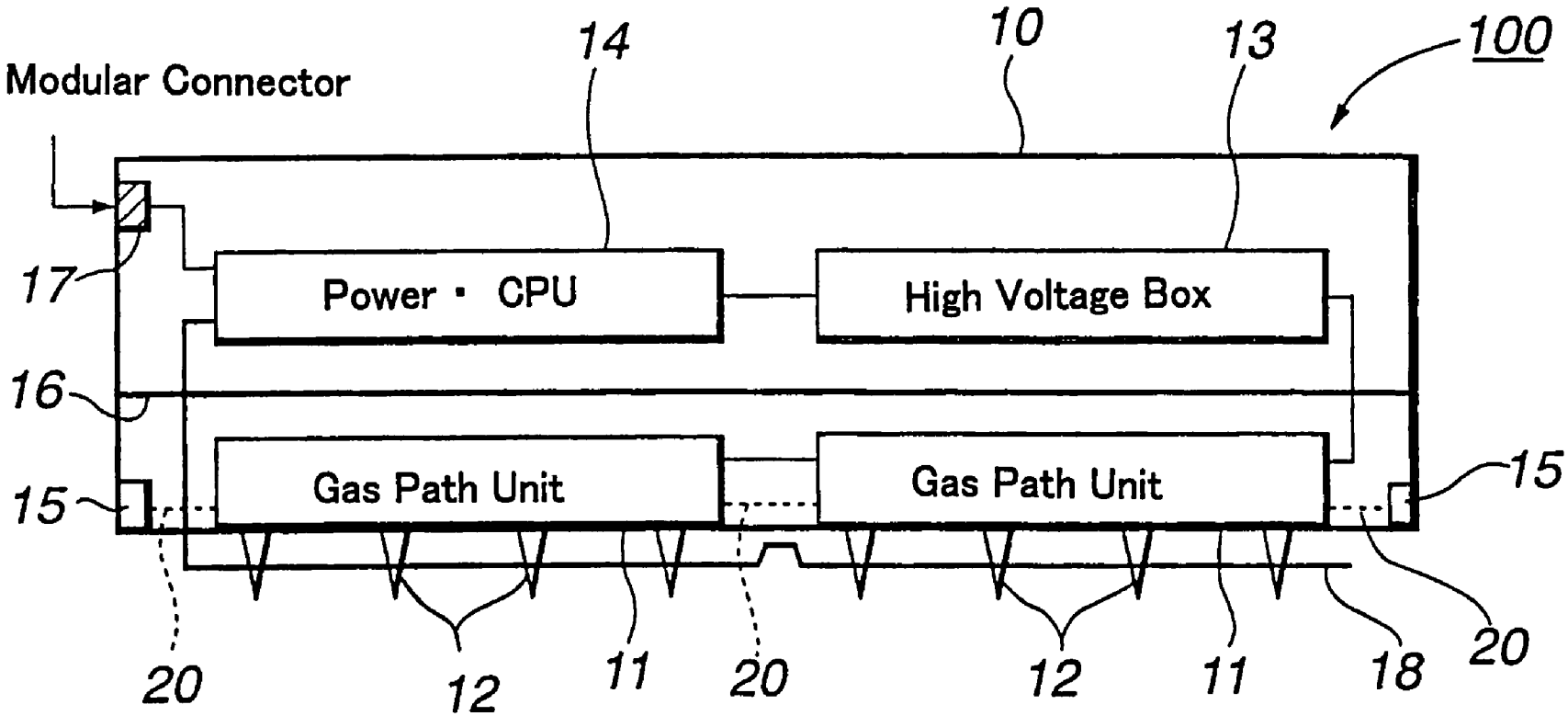
FIG. 1 is a diagram for explaining configuration of a discharge electrode bar according to an embodiment of the invention.
Figure 2:
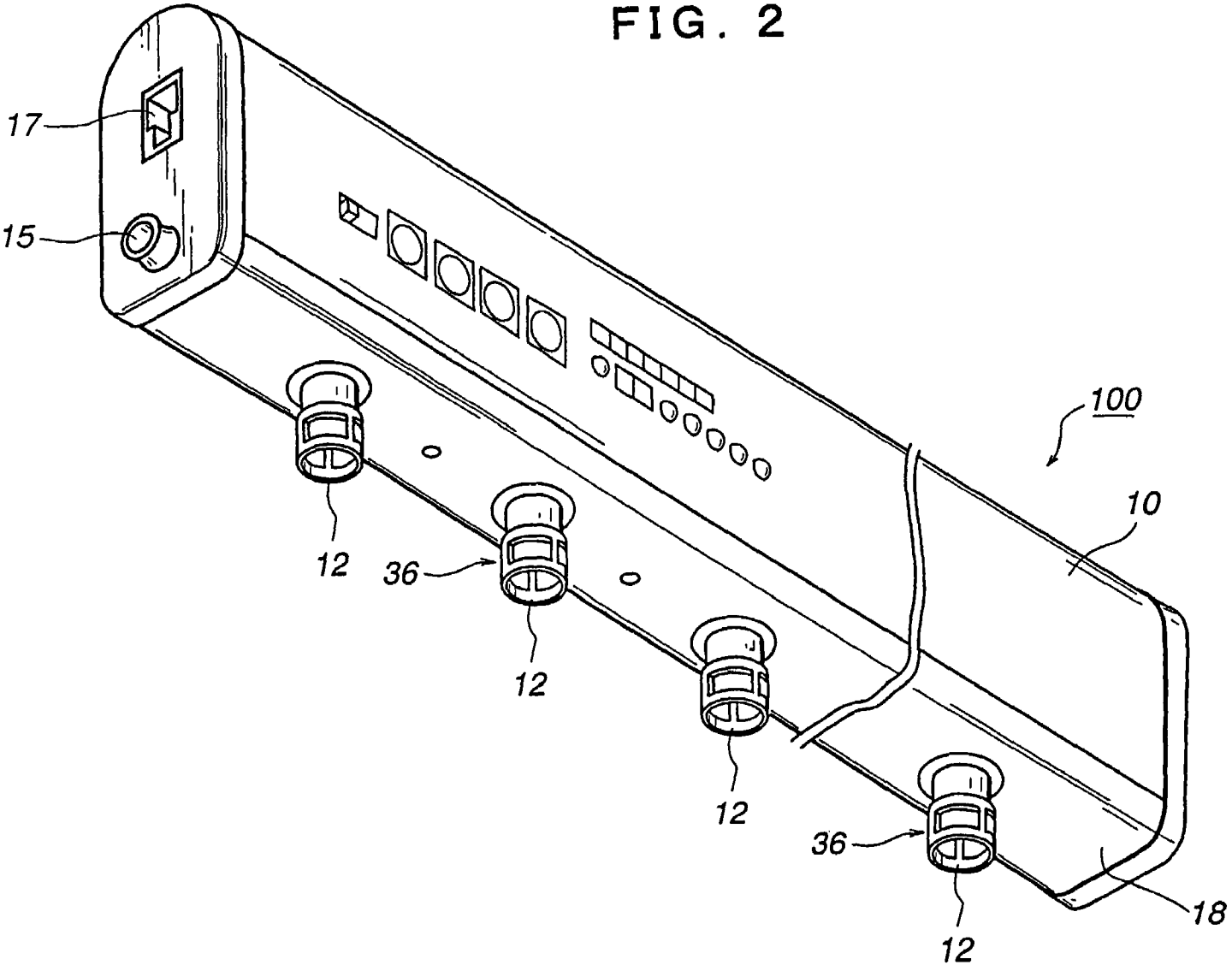
FIG. 2 is a perspective view showing an outer appearance of the discharge electrode bar according to the same embodiment.

FIG. 1 shows internal layout of a discharge electrode bar 100 in an ionizer according to an embodiment of the invention. FIG. 2 shows outer appearance of the discharge electrode bar 100 in its perspective view.

The discharge electrode bar 100 has an inverted U-shaped case 10 closed upward. In the lower region inside the case 10, a plurality of gas path units 11 and a plurality of discharge electrodes 12 having sharp tips (front ends) are arranged at intervals.

In an upper region inside the case 10, a high voltage unit 13 and a control unit 14 are located. The high voltage unit 13 is contained in a seal box. The control unit 14 includes a power supply circuit, display circuit, for example, and CPU. Opposite end surfaces of the case 10, which are lengthwise perimeters of the case 10, have clean gas ports 15. Through these clean gas ports, the gas path units 11 are supplied with clean gas, which may be inactive gas such as nitrogen gas or filtered air obtained by excluding dust, moisture, and preferably, organic compounds from atmospheric air. As explained later in greater detail, the clean gas once introduced into the gas path unit 11 is discharged externally along the discharge electrodes 12. Then, the clean gas passing through the discharge electrodes 12 becomes ionized air while entraining the atmospheric air, and flows down toward a work. If a gas containing organic compounds such as siloxane contacts the discharge electrodes 12, the organic compounds will be decomposed by corona discharge, and will cause the problem that a substance making a solid and adhering the discharge electrodes falls down for some reason. However, the instant embodiment removes this kind of problem by using clean gas not containing organic compounds and driving it to pass through the tips of the discharge electrodes 12.

The upper region and the lower region inside the case 10 are preferably separated by a partitioning wall 16 (FIG. 1) extending in the lengthwise direction to prevent substantial communication of air between these regions. Reference numeral 17 denotes a connection terminal that receives a modular connector for connecting the discharge electrode bar 100 to another one. Reference numeral 18 denotes a counter electrode plate connected to the ground potential. The counter electrode plate 18 is a member substantially forming a part of the case 10 to close the open bottom of the case 100.

Figure 3:
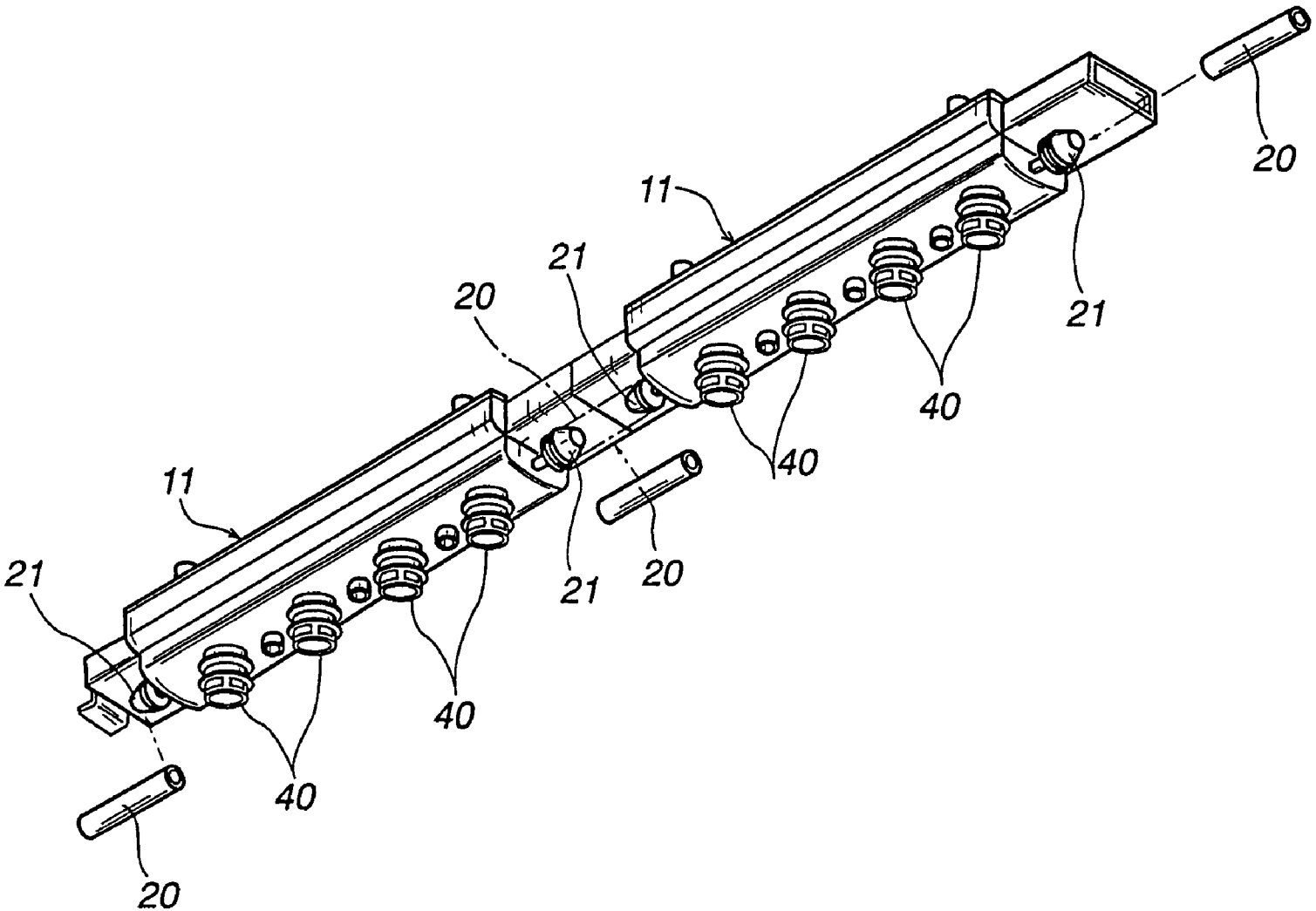
FIG. 3 is a perspective view of two gas path units connected together and located in a lower region inside the discharge electrode bar.
Figure 4:
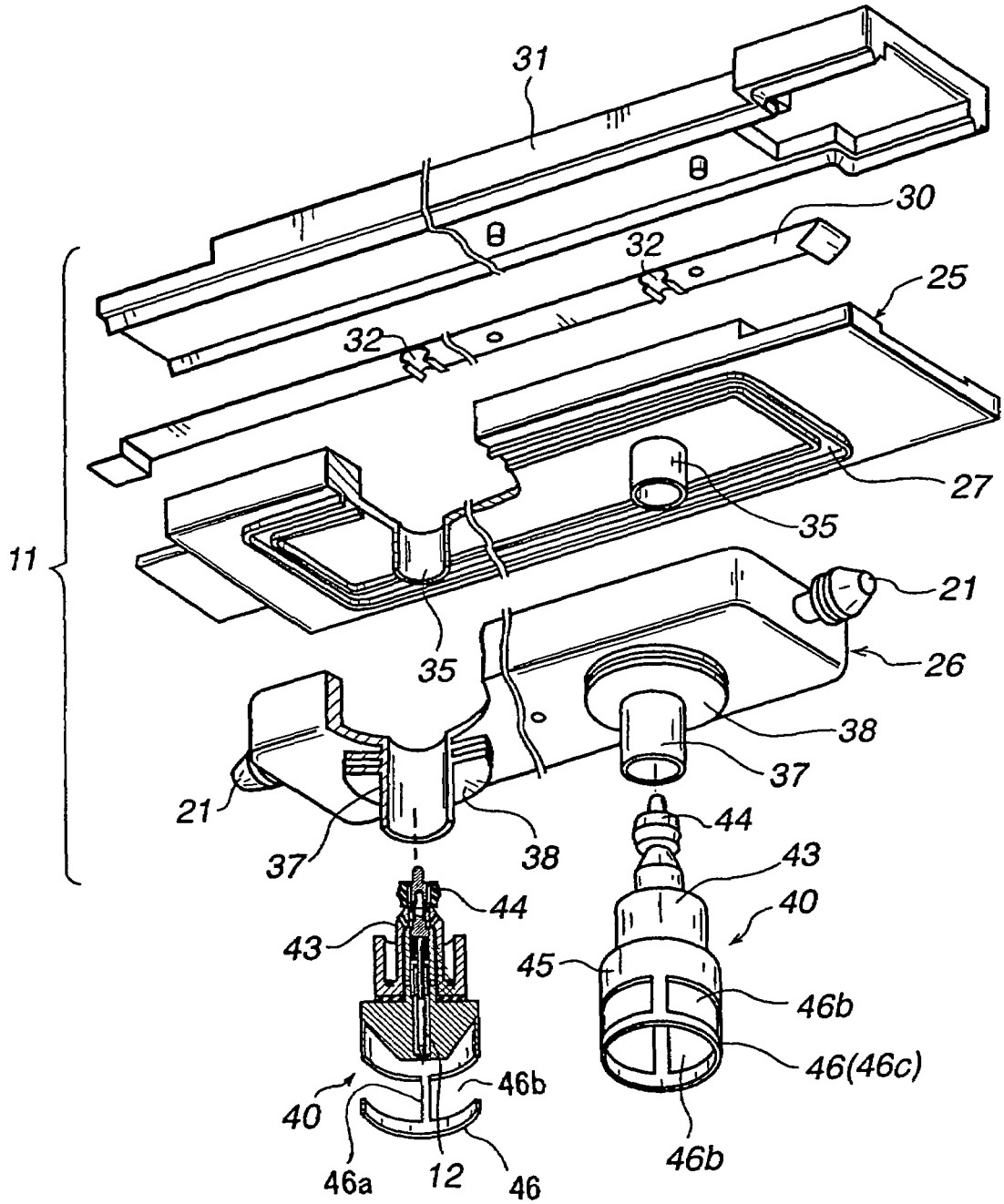
FIG. 4 is an exploded perspective view of a gas path unit including an electrode assembly.

FIG. 3 and FIG. 4 show the gas path unit 11 having an elongated shape and located to extend along the lengthwise direction of the case 10. FIG. 3 is a perspective view of two gas path units 11 connected together, and FIG. 4 is an exploded perspective view of one gas path unit 11.

As shown in FIG. 3, joints 21 for flexible connection tubes 20 are provided in end walls of each gas path unit 11, which are lengthwise perimeters of the gas path unit 11. A connection tubes 20 are brought into engagement with the joints 21 to connect adjacent two gas path units 11 together in communication with each other, or to connect one of gas path units 11 at the most end to the clean gas port 15 (FIGS. 1 and 2) in communication with teach other.

As best shown in FIG. 4, each gas path unit 11 comprises an elongated support plate 25 extending in the horizontal direction and a box-shaped member 26 opened upward. The support plate 25 has a rectangularly extending groove 27 on the bottom surface thereof. When the upper edge of the box-shaped member 26 engages the groove 27, a clean gas path 28 (FIG. 6) is defined. The clean gas path unit 28 communicates with the joints 21 explained above, which are formed in the end walls at the lengthwise opposite ends of the box-shaped member 26.

The support plate 25 supports a high voltage connector plate on its top surface. The high voltage connector plate 30 has an elongated shape extending in the lengthwise direction of the support plate 25. The high voltage connector plate 30 is supported by the support plate 25 and a fixing plate 31 placed on the support plate 25. The high voltage connector plate 30 has conductive connecting taps 32 at locations for alignment with the discharge electrodes 12. Instead of the conductive connecting taps 32 illustrated, the high voltage connector plate 30 may have spring-like contact segments made by local cutting and bending thereof. The support plate 25 has first sleeves 35 extending vertically at locations for alignment with the conductive connecting taps 32.

The box-shaped member 26 has second sleeves 37 at locations for alignment with the first sleeves 35 of the support plate 25. The second sleeves 37 preferably have circumferential flanges 38 at their pedestal ends to enlarge the creeping distance.

Figure 5:
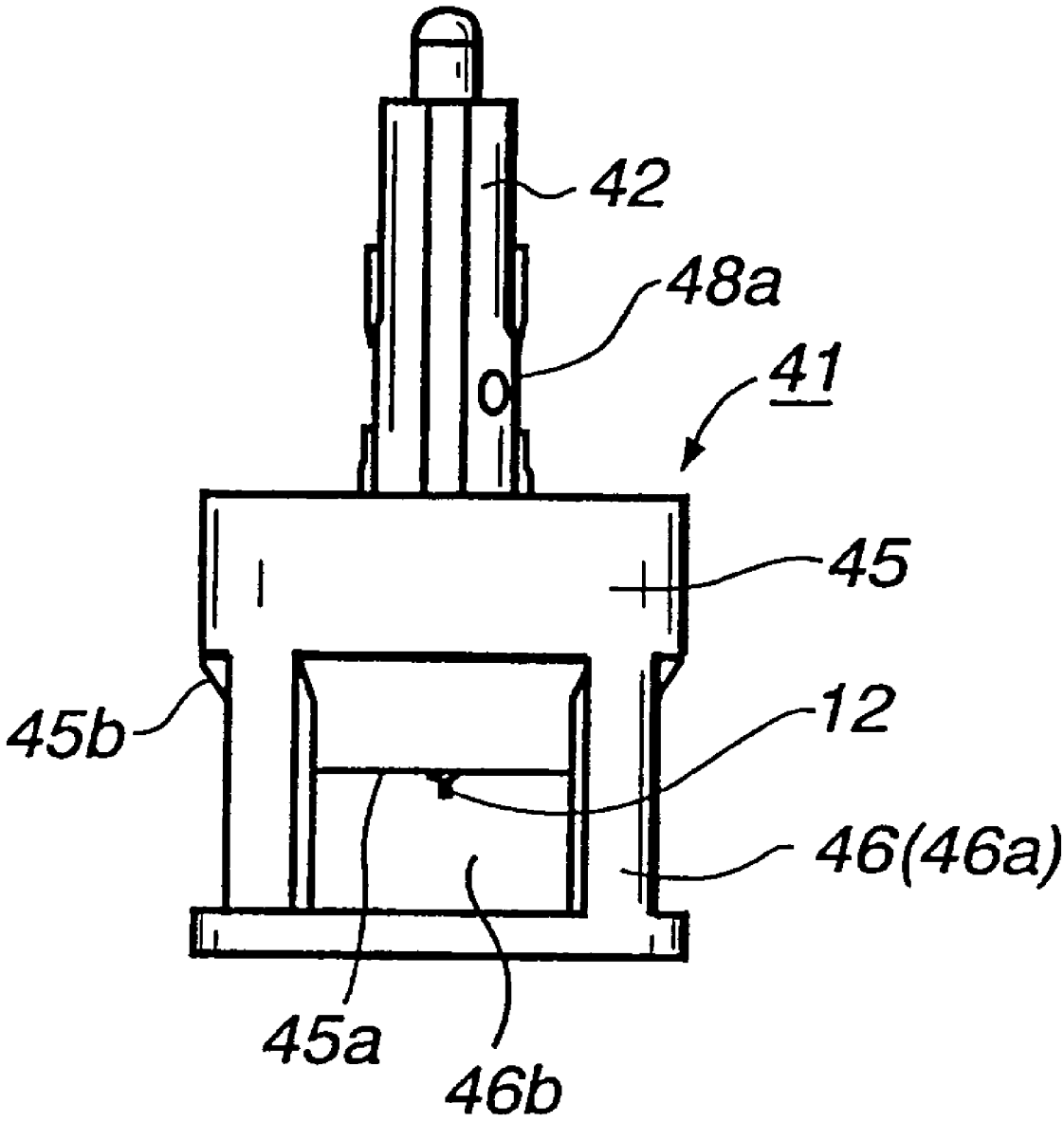
FIG. 5 is a side elevation of the main body of the electrode assembly.
Figure 6:
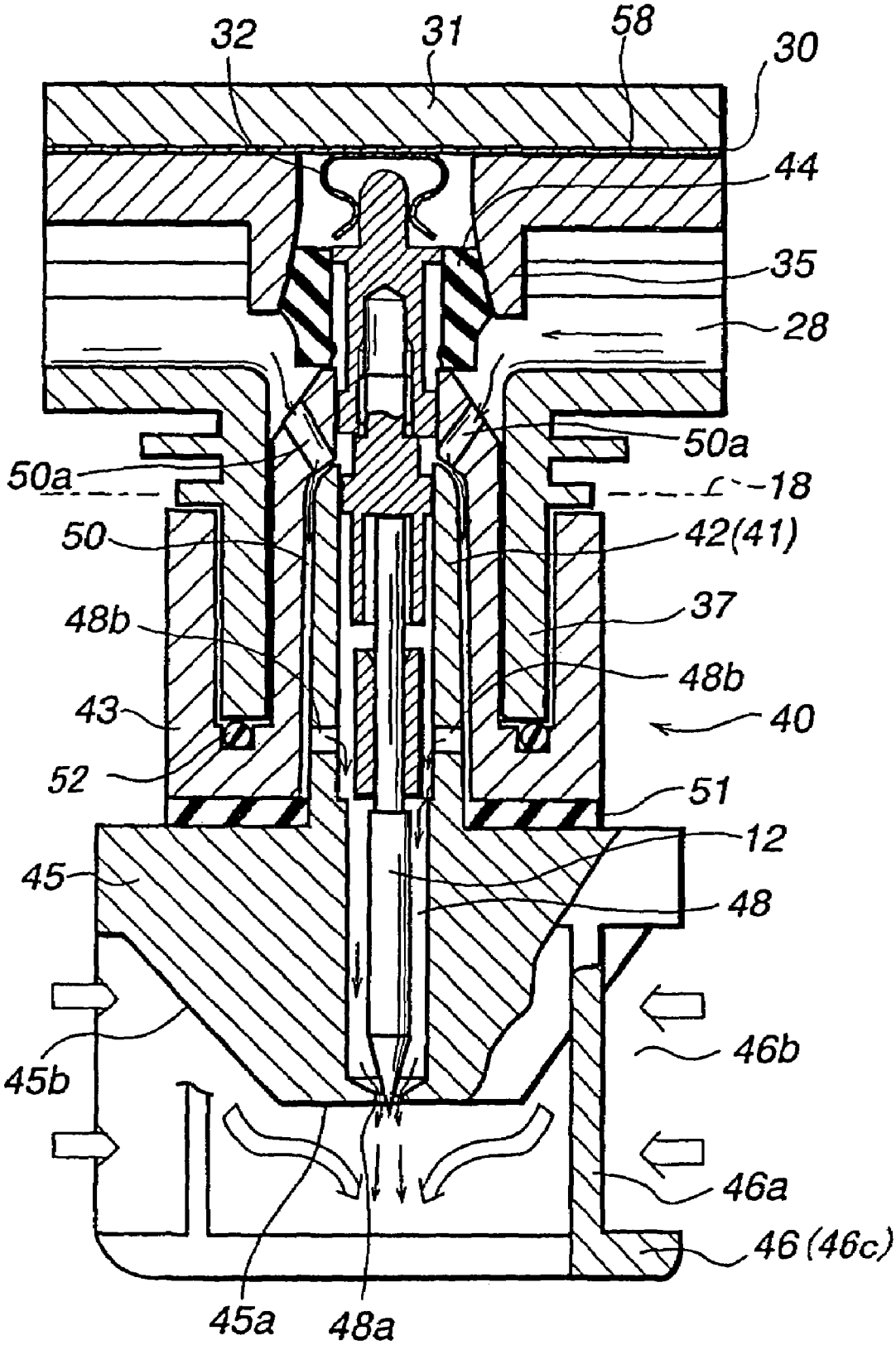
FIG. 6 is a cross-sectional view of the lower region of the discharge electrode bar and the electrode assembly.

The member labeled reference numeral 40 in FIGS. 4 and 6 is an electrode assembly. The electrode assembly 40 comprises a main body 41 (FIG. 5) for supporting a discharge electrode 12, an attachment 43 mounted on a shaft 42 of the main body 41, and a seal member 44 made of an elastic material such as rubber and mounted on the rear end portion of the shaft 42 of the main body 41.

The electrode main body 41 has an enlarged head portion 45 positioned adjacent to the tip of the discharge electrode 12. The enlarged head portion 45 is preferably configured to surround the tip of discharge electrode 12 and have a guard ring 46 having an opening in its center to ensure easy travel of air to be released from around the discharge electrode 12 through the opening. For positional fixture of the guard ring 46 relative to the enlarged head portion 45 and for introduction of external air into the guard ring 46, the guard ring 46 has a plurality of legs **46*a* spaced apart from the discharge electrode 12 by a predetermined distance and spaced apart from each other in the circumferential direction. The legs 46*a* connect to the enlarged head portion 45 and defines external air inlet openings 46*b* between every adjacent legs 46*a*, 46*a***.

The guard ring 46, illustrated, has the ring portion **46*c* having the shape of a circular ring as a finger guard at its distal end, and has a cylindrical outer contour as a whole. However, it may be configured to have a polygonal cross section provided it can be sized to ensure easy travel of air to be released from around the discharge electrode 12 and to reliably prevent accidental intrusion of operator's fingers. In addition, diametrical size of the guard ring 46 may be substantially equal to or smaller than the diametrical size of the rear end of the enlarged head portion 45**.

Each external air inlet opening **46*b* may be fully open without any obstacles as illustrated in the drawings. However, it may be net-shaped with a relatively large gauge to permit free passage of atmospheric air from outside, or it may be railing-shaped. For designing the guard ring 46, it is desirable to minimize the area occupied by the legs 46***a* and maximize the area of the external air inlet openings 46*b*.

The front end of the enlarged head portion 45 preferably has a form similar to a trapezoid defined by a flat surface 45*a* in the level of the tip of the discharge electrode 12 and a slanted side surface gradually sloping down from the outer circumferential edge of the flat horizontal surface 45*a*. The slanted side surface 45*b* preferably slopes such that its imaginary point of convergence falls on the imaginary extension of the axial line of the discharge electrode 12 at a position distant from the tip of the discharge electrode 12 by a predetermined distance that may be substantially equal to or slightly lower than the height of the guard ring 46.

The electrode main body 41 has a clean gas path 48 around the tip portion of the discharge electrode 12. The clean gas path 48 externally opens through a small outlet 48*a* that is coaxial with the tip of the discharge electrode 12. That is, the discharge electrode 12 is coaxial with the center axis of the clean gas path 48, and the tip of the discharge electrode 12 slightly projects forward of the small outlet 48*a*. The electrode main body 41 includes a shaft 42 having an inlet 48*b* extending in the radial direction thereof. The clean gas path 48 inside the electrode main body 41 communicates with the outside through the inlet 48*b*.

An attachment 43 surrounding the electrode main body 41 (shaft 42) cooperates with the shaft 42 to define a clean gas path 50. Clean gas is introduced into the clean gas path 50 around the shaft 42 from the clean gas path 28 inside the gas path unit 11 through an air inlet 50*a* near the distal end of the attachment 43.

When the electrode assembly 40 is brought into the second sleeve 37 of the gas path unit 11, the rear end of the discharge electrode 12 plugs into the connecting tap 32 of the high voltage connector plate 30, and the high voltage connector plate 30 and the discharge electrode 12 are electrically connected. At the same time, a part of the seal member 44 on the rear end of the shaft 42 enters into the first sleeve 35. Thus, the area of connection between the discharge electrode 12 and the high voltage connector plate 30 is sealed. That is, the junction between the discharge electrode 12 and the high voltage connector plate 30 is airtightly separated from the clean gas path 28 in the unit 11 by the seal member 44, and does not adversely affect the clean gas traveling through the gas path unit 11. Reference numeral 52 in FIG. 6 denotes an O ring.

Figure 7:
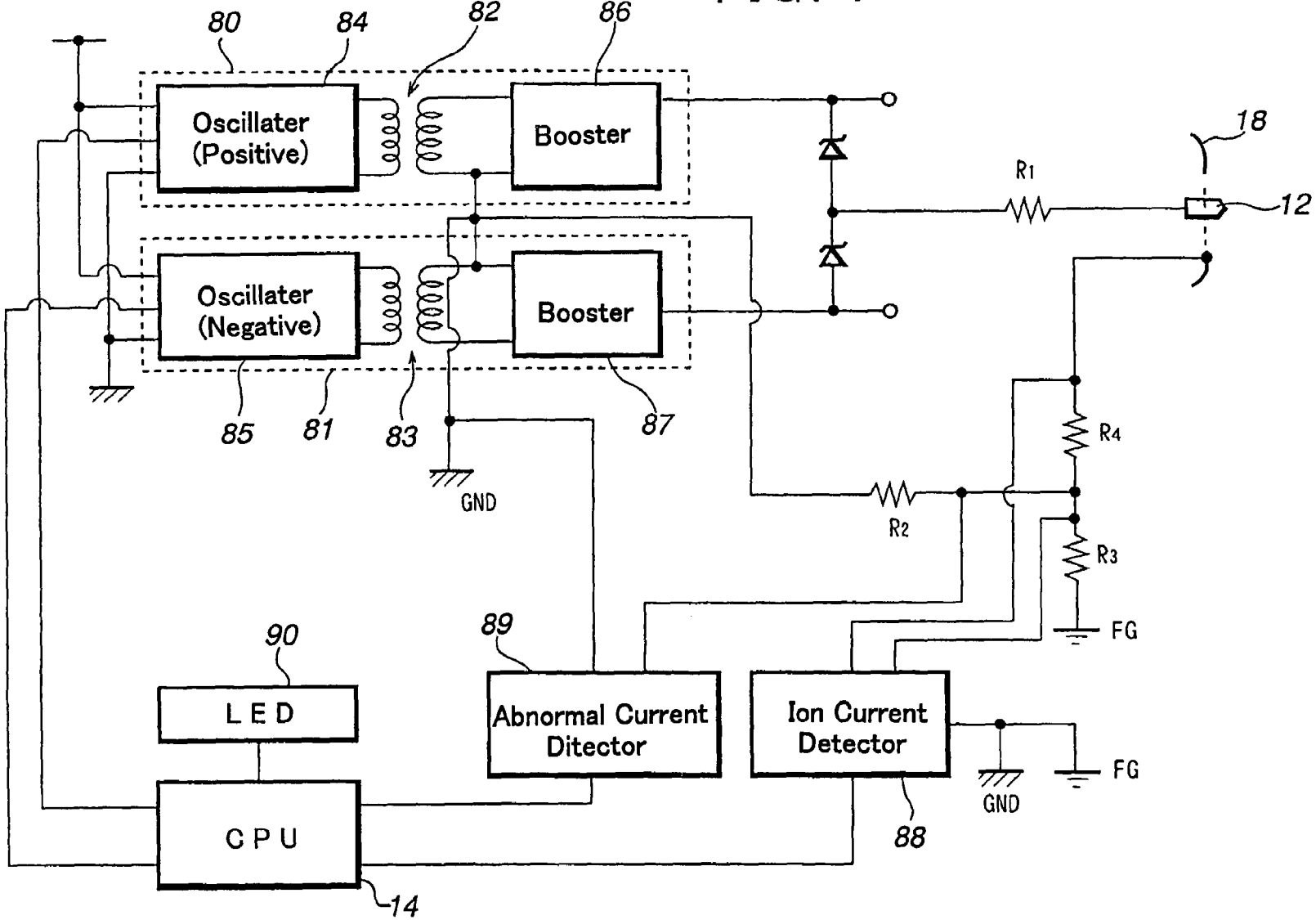
FIG. 7 is a circuit diagram of the discharge electrode bar.

FIG. 7 schematically shows the electric circuit of the discharge electrode bar 100. The discharge electrode bar 100 is of a pulse AC ion generating type for alternately generating plus ions and minus ions from the common discharge electrodes 12. The discharge electrode bar 100 includes a plus high voltage generator 80 and a minus high voltage generator 81 that make the high voltage unit 13. The high voltage unit 13 is housed in a seal box (not shown).

The plus high voltage generator 80 and the minus high voltage generator 81 include self-excited oscillators 84, 85 connected to primary coils of transformers 82, 83, and boosters 86, 87 such as multiplier/rectifier circuits connected to secondary coils of the transformers 82, 83. A protective resistor, i.e. first resistor R1 is connected in the line from the high voltage generators 80, 81 to the discharge electrode 12.

Between the grounded end GND of the secondary coil of the transformer 82, 83 and a frame ground FG, a second resistor R2 and a third resistor R3 are connected in series. Between the counter electrode plate 18 and the frame ground FG, a fourth resistor R4 and the third resistor R3 are connected in series.

By detecting the current flowing through the fourth resistor R4 with an ion current detector 88, ion balance near the discharge electrode 12 is known. By detecting the current flowing through the third resistor R3 with the ion current detector 88, ion balance near the work or a charged body is known. By detecting the current flowing through the second resistor R2 with an irregular discharge current detector 89, irregular discharge between the discharge electrode 12 and the counter electrode plate 18 or frame ground FG can be detected. If CPU 14 determines that irregular discharge has occurred, it can gives a notice on the irregularity to an operator by lighting a display LED 90 as an alarm means, for example.

The above-explained circuit is of a pulse AC discharge electrode bar 100. However, the discharge electrode bar may be of an AC type for generating plus ions and minus ions alternately with a commercial frequency, an SSDC type for generating plus ions and minus ions simultaneously, or a pulse DC type for generating plus ions and minus ions alternately.

In operation of the discharge electrode bar 100, clean gas in the gas path unit 11 enters into the clean gas path 50, 48 forming the internal path of the electrode assembly 40 through the air inlet 50*a* of the attachment 43. The clean gas then travels through the internal clean gas path 50, 48, and it is discharged from the small gas outlet 48*a* encircling the tip of the discharge electrode 12. Reference numeral 51 in FIG. 6 denotes a seal member that seals the gap between the attachment 43 and the enlarged. head portion 45 of the electrode main body 41.

The embodiment explained above makes it easy to replace the discharge electrode 12 with a new one by simply extracting or inserting the electrode assembly 40 or 41. In addition, the tip of the discharge electrode 12 is not enclosed by a conventional-type sleeve-shaped nozzle and substantially exposed outside. Therefore, the embodiment can prevent undesirable relaxation of the electric field around the electrode tip, which will occur when a conventional-type sleeve-shaped nozzle electrically charges in the same polarity as that of the discharge electrode 12. As a result, the embodiment can increase the yield of ions.

Furthermore, the clean gas supplied from the gas source through the clean gas ports 15 is discharged from the small outlet 48*a*, which is coaxial with the tip of the discharge electrode 12, and encloses the tip. Therefore, the embodiment can prevent adhesion of foreign matters onto the tip of the discharge electrode 12, and in other words, the embodiment can prevent contamination of the electrode tip.

The clean gas discharged from the small outlet 48*a* is ionized immediately after passing by the discharge electrode 12. Then, it entrains the atmospheric air supplied affluently through the guard ring 46 and existing around it, and flows down in form of a relatively large flow of ionized air. The phenomenon of entrainment of the atmospheric air by the clean gas appears more prominently when the flow rate of the clean gas from the small outlet 48*a* is equal to or higher than 40 m/sec.

As already explained, the discharge electrode 12 is coaxial with the center axis of the clean gas path 48, and the tip of the discharge electrode 12 rides on the center axis of the small gas outlet 48*a* and projects forward of the gas outlet 48*a*. The tip of the discharge electrode 12 had better project forward of the gas outlet 48*a*, i.e. the flat surface 45*a* of the enlarged head portion 45, to increase the yield of ionized air. However, if the tip of the discharge electrode 12 projects too much from the gas outlet 48*a*, it again invites the problem that the open air contaminates the tip of the discharge electrode 12. Therefore, it is recommended to determine the height of projection of the discharge electrode 12 above the gas outlet 48*a* to keep the balance between the yield of the ionized air and the ability of preventing contamination of the discharge electrode 12.

In case the guard ring 46 permitting free passage of air is provided around the tip of the discharge electrode 12, the guard ring 46 prevents operators from accidental touch to the tip of the discharge electrode during removal or insertion of the electrode assembly 40, and hence enhances the safety of the ionizer. To assure this function of the guard ring 46, height of the guard ring 46 is preferably from 0.5 mm to 14 mm, and diameter thereof is preferably from 2.5 mm to 10 mm.

Figure 8:
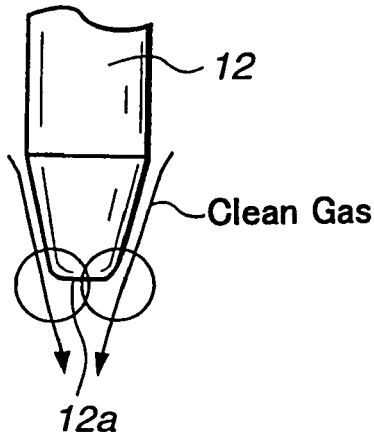
FIG. 8 is a partial side elevation of a modified tip (front end) of a discharge electrode that is an element of the electrode assembly.
Figure 9:
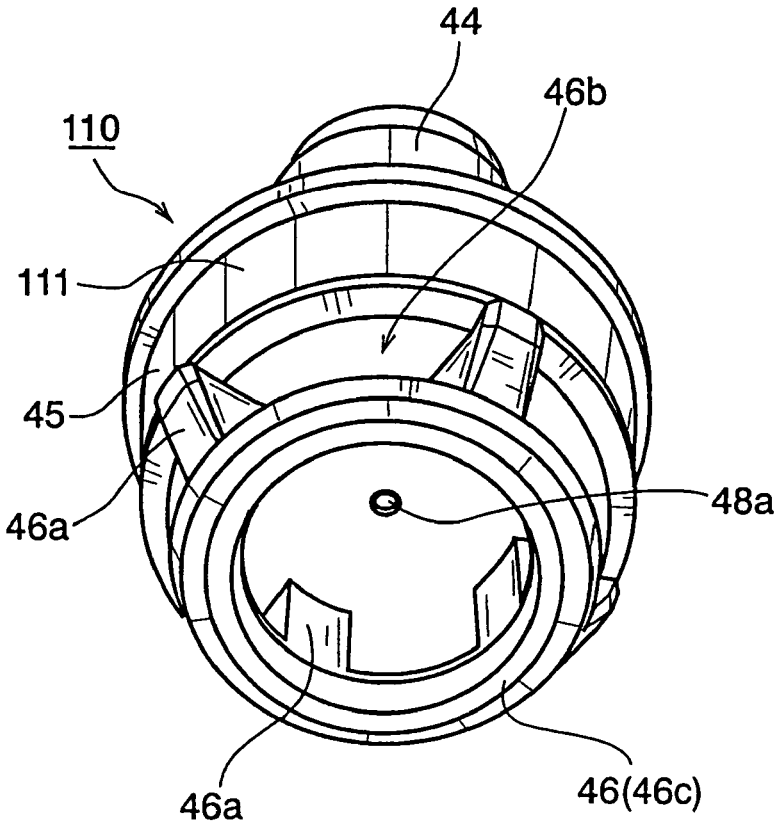
FIG. 9 is a view of the modified electrode assembly, taken from an upper front direction.

The function of preventing adhesion of foreign matters on the tip of the discharge electrode 12 by clean gas can be enhanced by cutting the sharp front end (tip) of the discharge electrode in a frustum-like form as shown in FIG. 8. In this case, the electric field concentrates to rounded outer marginal region of the top surface 12*a* (the region in circles in FIG. 8). Since this region gets a strong blow of clean gas jetting out from the small outlet 48*a*, the effect of the clean gas to prevent adhesion of foreign matters is enhanced.

FIGS. 9 through 13 show a modified electrode assembly 110. The electrode assembly 110 shown here is directly mounted on the second sleeve 37 without the attachment 43. Therefore, the electrode assembly 110 includes a mount portion 111 continuous from the enlarged head portion 45. The mount portion 111 has a substantially annular recess well 112 (FIGS. 10 and 13) for receiving the second sleeve 37. Reference numeral 113 in FIG. 13 denotes a groove for receiving the O-ring 52.

Figure 10:
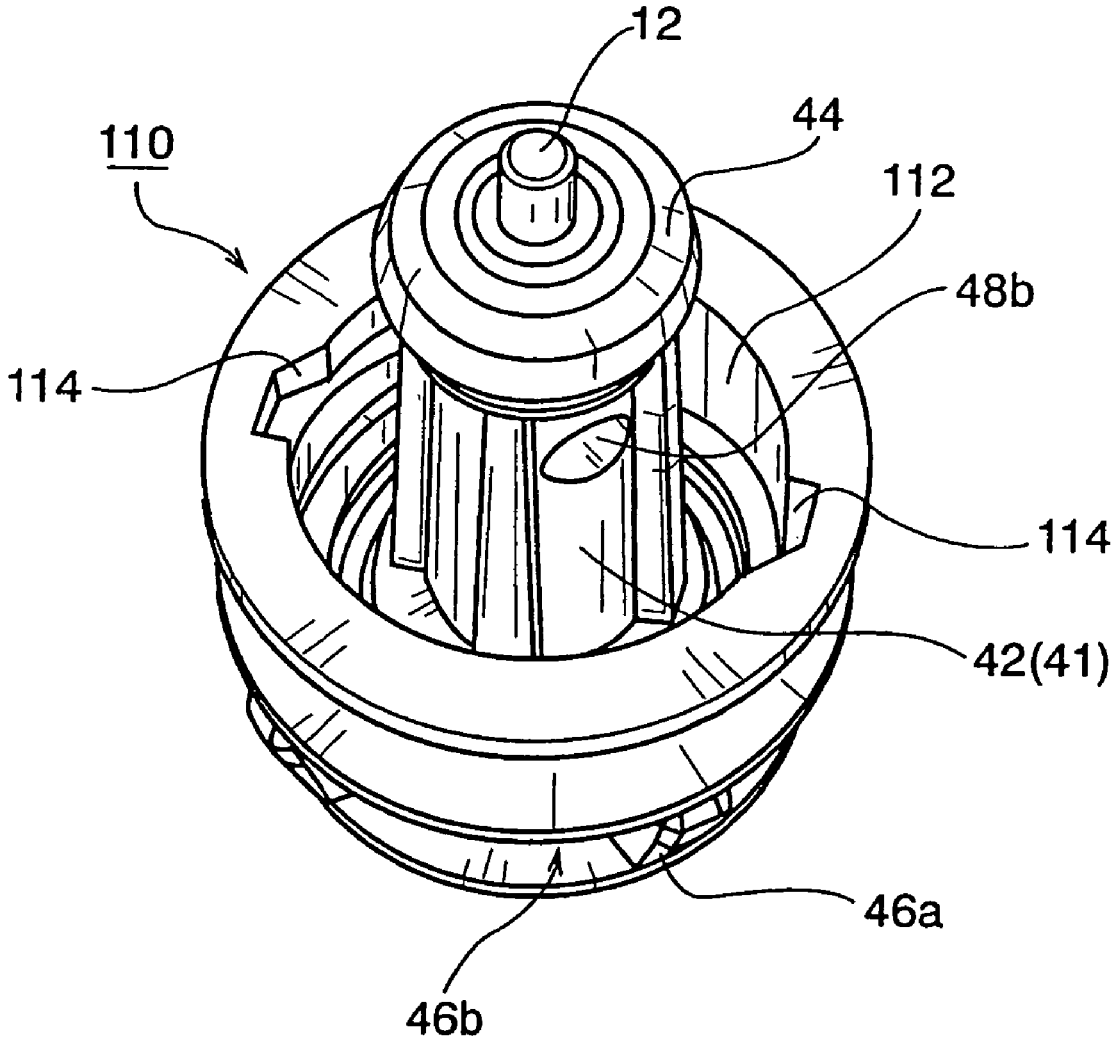
FIG. 10 is a view of the electrode assembly of FIG. 9, taken from an upper back direction.

L-shaped key grooves 114 are formed to indent into the outer wall of the recess well 112 of the mount portion 111. These key grooves 114 open to the rear end of the mount portion 111 as best shown in FIG. 10. The key grooves 114 receive projections (not shown) formed on the second sleeve 37. When the electrode assembly 110 is assembled with the second sleeve 37, projections of the second sleeve 37 are brought into alignment with the key grooves 114 of the electrode assembly 110, and the second sleeve 37 is driven into the annular recess well 112 of the mount portion 111 of the electrode assembly. Thereafter, the electrode assembly 110 is rotated relative to the second sleeve 37. As a result, the electrode assembly 110 is held immovable in the axial direction relative to the second sleeve 37.

In the electrode assembly 110, clean gas is supplied to the gas inlet 48*b* in the shaft 42 from the internal clean gas path 28 (FIG. 6) of the discharge electrode bar 100. The clean gas entering through the gas inlet 48*b* travels through the gas path 48 around the discharge electrode 12, and it is thereafter discharged externally through the small outlet 48*a* around the tip of the discharge electrode 12.

Figure 11:
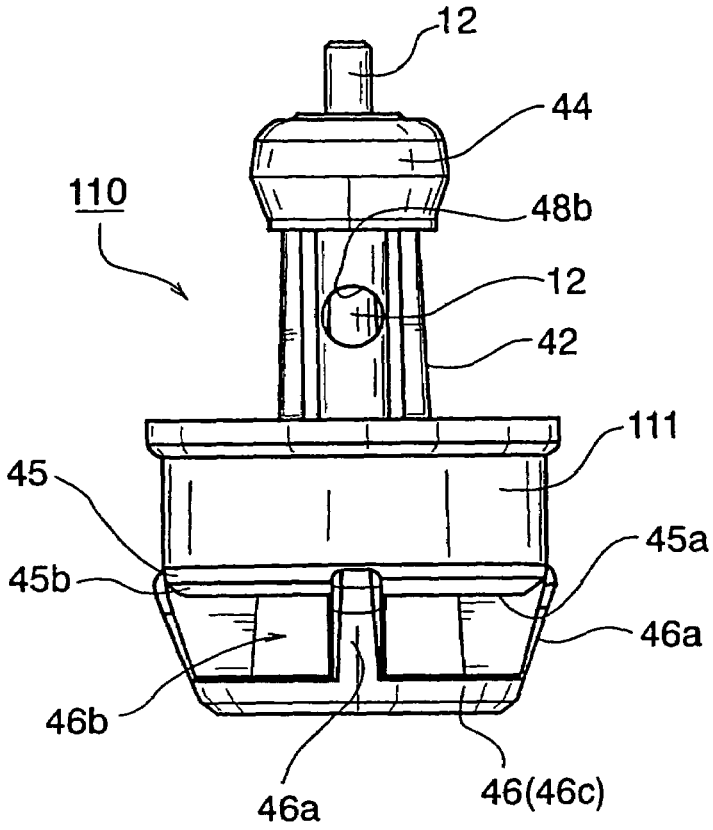
FIG. 11 is a side elevation of the electrode assembly of FIG. 9.
Figure 12:
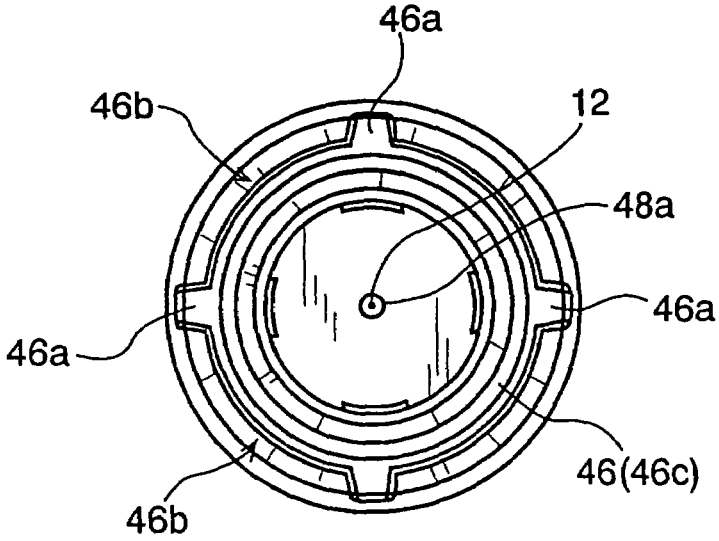
FIG. 12 is a front elevation of the electrode assembly of FIG. 9.
Figure 13:
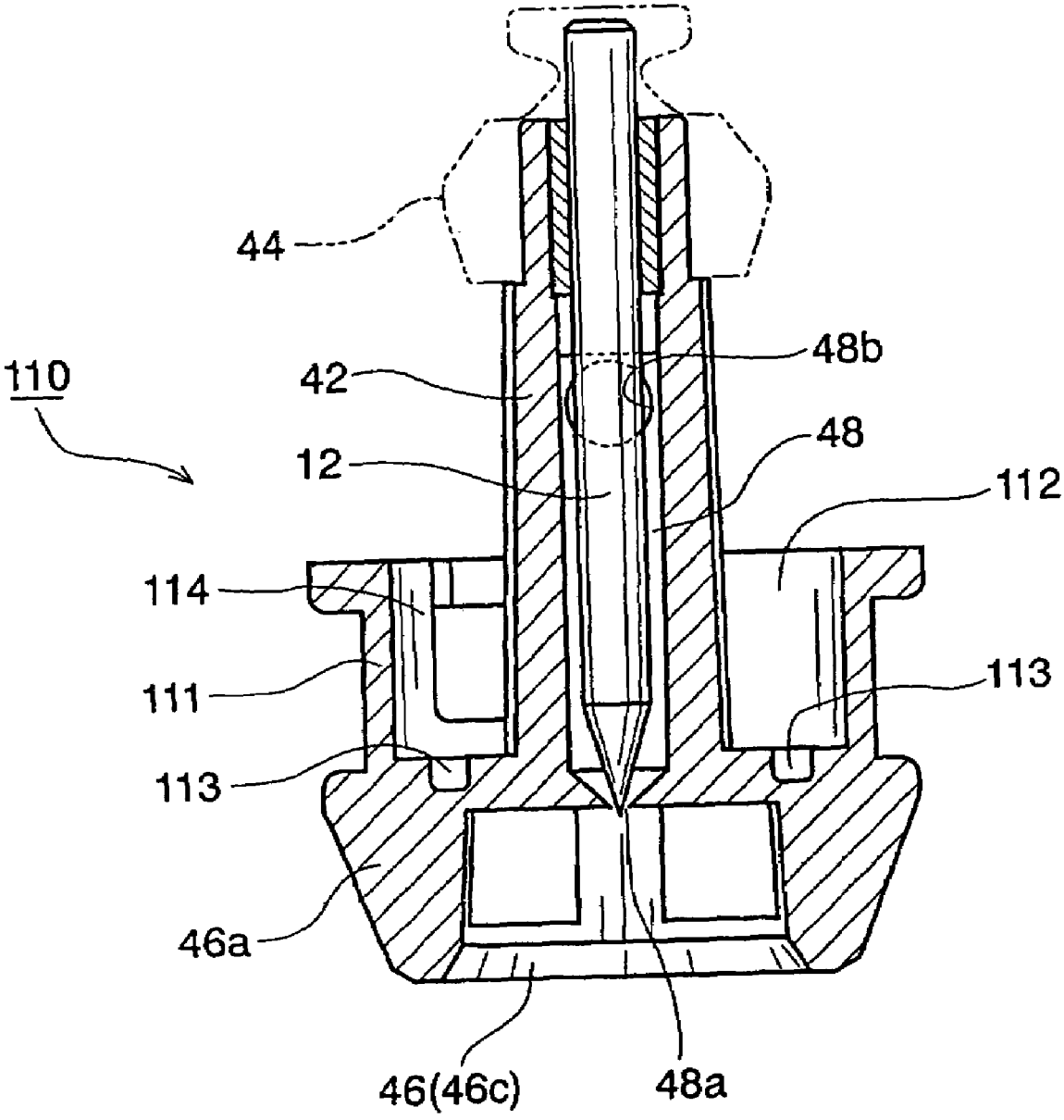
FIG. 13 is a cross-sectional view of the electrode assembly of FIG. 9.
Figure 14:
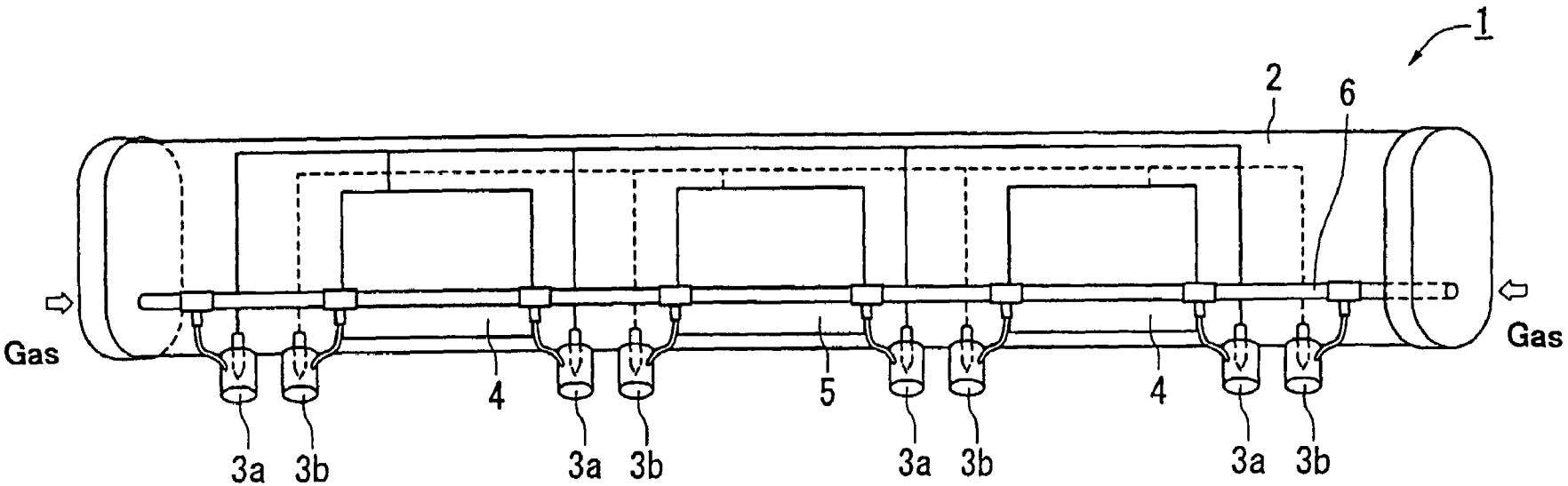
FIG. 14 is a diagram for explaining configuration of a discharge electrode bar of a conventional ionizer.

In the electrode assembly 40 shown in FIGS. 5 and 6 and the electrode assembly 110 shown in FIGS. 11 through 13, distance from the horizontal surface 45*a* to the front end surface of the ring main body 46*c* is preferably about 5 mm. Inner diameter of the ring main body 46*c* is preferably about 9 mm. Height of the tip of the discharge electrode 12 projecting from the horizontal surface 45*a* is preferably about 0.5 mm. Furthermore, total area of four external air inlet openings 46*b* between every adjacent legs 46*a*, 46*a* of the guard ring 46 is preferably about 67% relative to the area of the imaginary circumferential wall, which is the sum of the area occupied by the legs 46*a* and the area occupied by the external air inlet openings 46*b*. In other words, the total area of four legs 46*a* is approximately 33% of the area of the imaginary circumferential wall.

What is claimed is:

1. An ionizer for generating ionized air by applying a high voltage to a discharge electrode and bringing about corona discharge, comprising:

an electrode assembly having a main body supporting the discharge electrode in a configuration to surround an entirety of the discharge electrode other than a front end thereof, said electrode assembly further having a clean gas path along a front end portion of the discharge electrode in the main body, said clean gas path having a clean gas outlet coaxial with the front end of the discharge electrode, wherein a region of the main body around and forward of the front end of the discharge electrode is exposed to external atmospheric air, and wherein the main body of said electrode assembly has an inclined surface for guiding the external atmospheric air toward a position forward and spaced apart from the front end of the discharge electrode along a lengthwise direction of the discharge electrode so that the external atmospheric air merges with a clean gas flowing out from said clean gas outlet.

2. The ionizer according to claim 1 wherein the front end of the discharge electrode has a frustum-like shape without a sharp end.

3. The ionizer according to claim 1 further comprising:

a guard ring provided around the front end of the discharge electrode, said guard ring being configured to permit free pass of atmospheric air.

4. The ionizer according to claim 3 wherein said guard ring has a ring main body extending over the entire circumference thereof and capable of preventing intrusion of a finger tip.

5. The ionizer according to claim 3 wherein the main body of said electrode assembly has a horizontal surface around the front end of the discharge electrode and the inclined surface includes a slanted side surface extending from the outer circumference of the horizontal surface with an inclination.

6. The ionizer according to claim 5 wherein the inclination of the slanted side surface is determined such that the point of convergence of the slanted side surface falls on the axial line of the discharge electrode at a point distant from the front end of the discharge electrode by a predetermined distance, said point being in a level substantially equal to or lower than the height of said guard ring.

7. The ionizer according to claim 3 wherein the ionizer is in form of a discharge electrode bar including a plurality of discharge electrodes aligned at intervals, wherein the discharge electrode bar includes a high voltage connector plate extending therein in the lengthwise direction thereof, and includes sleeves each capable of receiving said electrode assembly to electrically connect the discharge electrode of the inserted electrode assembly to the high voltage connector plate.

8. The ionizer according to claim 7 wherein each said sleeve has a circumferential flange at a pedestal end thereof to enlarge the creeping distance.

9. The ionizer according to claim 1 wherein the front end of the discharge electrode projects outward of said clean gas outlet of said clean gas path.

10. The ionizer according to claim 9 further comprising a ring-shaped member integral with said electrode assembly at a position forward and spaced apart from the front end of the discharge electrode in an axial direction of the discharge electrode.

11. The ionizer according to claim 1 wherein the main body of said electrode assembly has a horizontal surface around the front end of the discharge electrode, and wherein an inclined outer circumferential surface of said electrode assembly is continuous from an outer circumferential perimeter of the horizontal surface.

12. An ionizer for generating ionized air by applying a high voltage to a discharge electrode and bringing about corona discharge, comprising:

an electrode support member which supports the discharge electrode in a configuration to surround an entirety of the discharge electrode other than a front end thereof, said electrode support member having a clean gas path that is formed along a front end portion of the discharge electrode to permit a clean gas to flow through said clean gas path and includes a clean gas outlet at a front terminal thereof to externally release the clean gas therein from around the front end of the discharge electrode; and a guard ring including a ring main body having a main opening at a location forward and spaced apart by a predetermined distance in the lengthwise direction of the discharge electrode from the electrode support member to permit a flow of the ionized air to go out through the main opening, and including a plurality of legs connecting the ring main body to said electrode support member, wherein said electrode support member has an inclined surface that guides external atmospheric air flowing in through external air inlet openings between every adjacent leg of said plurality of legs toward a position forward and spaced apart from the front end of the discharge electrode along a lengthwise direction of the discharge electrode so that the external atmospheric air merges with a clean gas flowing out from said clean gas outlet, wherein the ring main body has a shape continuous in the circumferential direction and has a diameter small enough to prevent intrusion of a finger tip, and wherein the clean gas flow enclosing the front end of the discharge electrode produces ionized air while inhaling atmospheric air which enters into said guard ring through said external air inlet openings.

13. An ionizer for generating ionized air by applying a high voltage to a discharge electrode and bringing about corona discharge, comprising:

a discharge electrode;

an electrode support member which supports the discharge electrode in a configuration to surround an entirety of the discharge electrode other than a front end thereof, said electrode support member having a clean gas path that is formed along a front end portion of the discharge electrode to permit a clean gas to flow through the clean gas path and includes a clean gas outlet around the front end of the discharge electrode to externally release the clean gas forward through the clean gas outlet;

a finger guard provided at a location forward and spaced apart from the front end of the discharge electrode, and having an opening which prevents finger contact to the front end of the discharge electrode from the front outside while permitting the ionized air to flow out forward therethrough; and a plurality of legs connecting said finger guard to said electrode support member, wherein said electrode support member has an inclined surface that guides external atmospheric air flowing in through external air inlet openings between every adjacent leg of said plurality of legs toward a position forward and spaced apart from the front end of the discharge electrode along a lengthwise direction of the discharge electrode so that the external atmospheric air merges with a clean gas flowing out from said clean gas outlet.

14. A discharge electrode assembly detachably assembled in an ionizer for generating ionized air by applying a high voltage to a discharge electrode and bringing about corona discharge, comprising:

a discharge electrode;

an electrode support member which supports the discharge electrode in a configuration to surround an entirety of the discharge electrode other than a front end thereof, said electrode support member having a clean gas path along a front end portion of the discharge electrode to permit a clean gas to flow through said clean gas path and includes a clean gas outlet around the front end of the discharge electrode with the clean gas;

a finger guard provided at a location distant forward from the front end of the discharge electrode, and has a main opening which prevents finger contact to the front end of the discharge electrode from the front outside while permitting the ionized air to flow out forward therethrough; and a plurality of legs connecting said finger guard to said electrode support member, wherein said electrode support member has an inclined surface that guides atmospheric air flowing in through air inlet openings between every adjacent leg of said plurality of legs toward a position forward and spaced apart from the front end of the discharge electrode along a lengthwise direction of the discharge electrode so that the atmospheric air from through the air inlet openings merges with a clean gas flowing out from said clean gas outlet.

15. The discharge electrode assembly according to claim 14 wherein said finger guard is ring-shaped.

* * * * *